US009147521B2

(12) United States Patent
Yamamoto et al.

(10) Patent No.: US 9,147,521 B2
(45) Date of Patent: Sep. 29, 2015

(54) REACTOR

(75) Inventors: Shinichiro Yamamoto, Osaka (JP); Masayuki Kato, Osaka (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 120 days.

(21) Appl. No.: 13/503,960

(22) PCT Filed: Oct. 26, 2010

(86) PCT No.: PCT/JP2010/068985
§ 371 (c)(1),
(2), (4) Date: Apr. 25, 2012

(87) PCT Pub. No.: WO2011/052600
PCT Pub. Date: May 5, 2011

(65) Prior Publication Data

US 2012/0206232 A1 Aug. 16, 2012

(30) Foreign Application Priority Data

Oct. 29, 2009 (JP) ..... 2009-248394
Oct. 20, 2010 (JP) ..... 2010-235199

(51) Int. Cl.
*H01F 27/24* (2006.01)
*H01F 17/06* (2006.01)
(Continued)

(52) U.S. Cl.
CPC ..... *H01F 37/00* (2013.01); *H01F 3/14* (2013.01); *H01F 27/306* (2013.01)

(58) Field of Classification Search
CPC ..... H01F 27/263; H01F 27/306; H01F 3/14; H01F 37/00
USPC ..... 336/212, 178, 220, 221, 222, 233
See application file for complete search history.

(56) References Cited

U.S. PATENT DOCUMENTS 5,719,544 A * 2/1998 Vinciarelli et al. ..... 336/84 C
5,926,946 A * 7/1999 Minato et al. ..... 29/606
(Continued)

FOREIGN PATENT DOCUMENTS

CN 1938794 A 3/2007
CN 101405822 A 4/2009
(Continued)

OTHER PUBLICATIONS

Office Action issued in Chinese Patent Application No. 201080048273.3 dated Aug. 5, 2013.
(Continued)

*Primary Examiner* — Elvin G Enad
*Assistant Examiner* — Kazi Hossain
(74) *Attorney, Agent, or Firm* — Venable LLP; Michael A. Sartori; Tamatane J. Aga

(57) ABSTRACT

To provide a reactor whose number of components is small and that exhibits excellent assemblability. A reactor 1 includes a coil 2 having a pair of coil elements 2*a* and 2*b*, and a core unit 3 having a pair of intermediate core portions 30 around which the coil elements 2*a* and 2*b* are respectively disposed. The core unit 3 is formed to be annular by a combination of intermediate core pieces 31 that structure intermediate core portions 30, a pair of end core pieces 32 that clamps a pair of intermediate core portions 30 disposed in parallel to each other, and gap members 3*g* each disposed between each ones of the core pieces. The end core pieces 32 respectively include clamping faces 321 for clamping the intermediate core portions 30, each structured with a single plane. An installed face 320*l* of each of the end core pieces 32 projects further than the installed face 31*l* of the intermediate core pieces 31. One gap member 3*g* is interposed between the end core piece 32 and the intermediate core portion 30, and relative permeability of the gap member 3*g* is greater than 1. This structure simplifies the shape of the core pieces, and allows the number of components to be small despite the core unit 3 partially projects.

8 Claims, 10 Drawing Sheets

(51) Int. Cl.

| | |
|---|---|
| ***H01F 27/28*** | (2006.01) |
| ***H01F 37/00*** | (2006.01) |
| ***H01F 3/14*** | (2006.01) |
| *H01F 27/30* | (2006.01) |

(56) References Cited

U.S. PATENT DOCUMENTS

| | | | | |
|---|---|---|---|---|
| 6,980,077 | B1 | 12/2005 | Chandrasekaran et al. | |
| 7,482,977 | B2 * | 1/2009 | Kuroda et al. | 343/700 MS |
| 7,782,168 | B2 * | 8/2010 | Nakatsu et al. | 336/221 |
| 2005/0212642 | A1 * | 9/2005 | Pleskach et al. | 336/200 |
| 2006/0255029 | A1 * | 11/2006 | Bone, Jr. | 219/672 |
| 2009/0027151 | A1 * | 1/2009 | Nakatsu et al. | 336/212 |
| 2009/0108971 | A1 * | 4/2009 | Okamoto | 336/65 |
| 2011/0025444 | A1 * | 2/2011 | Sugiyama et al. | 336/212 |
| 2011/0156853 | A1 * | 6/2011 | Kato et al. | 336/192 |

FOREIGN PATENT DOCUMENTS

| | | | |
|---|---|---|---|
| JP | 05-036545 | * | 2/1993 |
| JP | 2008-041879 | A | 2/2008 |
| JP | 2008-041880 | | 2/2008 |
| JP | 2009-026995 | A | 2/2009 |
| JP | 2009-218294 | | 9/2009 |
| JP | 2009-231390 | | 10/2009 |
| JP | 2009-246221 | | 10/2009 |
| JP | 2009-246239 | | 10/2009 |

OTHER PUBLICATIONS

Xu Zheng et al., "Modern functional ceramics," National Defense Industry Press, Sep. 30, 1998.

Office Action in Chinese Patent Application No. 201080048273.3, dated Mar. 14, 2014.

* cited by examiner

REACTOR

TECHNICAL FIELD

The present invention relates to a reactor used as a constituent component of, e.g., an in-vehicle DC-DC converter installed in a vehicle such as a hybrid vehicle. In particular, the present invention relates to a reactor that is made up of a small number of components and exhibits excellent assemblability.

BACKGROUND ART

One of the components of a circuit that steps up or steps down voltage is a reactor. For example, Patent Literature 1 discloses a reactor that is used as a circuit component of a converter installed in a vehicle such as a hybrid vehicle. As shown in FIG. 10(A), a reactor 100 includes a coil 102 that has a pair of coil elements 102*a* and 102*b* being paralleled such that their respective axes are in parallel to each other, and an annular core unit 103 that has a pair of intermediate core portions 1030 around which the coil elements 102*a* and 102*b* are disposed. Note that, in FIG. 10(A), one coil element 102*a* is shown as being partially cut-out, such that the core pieces can clearly be seen.

The core unit 103 is structured with: a plurality of rectangular parallelepiped shaped intermediate core pieces 1031 that structure corresponding intermediate core portions 1030; a pair of U-shaped core pieces 103*u* disposed so as to clamp the opposite end faces of the intermediate core portions 1030 disposed in parallel to each other; and a plurality of gap members 103*g* each interposed between each ones of the core pieces for adjusting the inductance of the reactor 100. The U-shaped core pieces 103*u* are not provided with the coil 102 except for a pair of leg portions thereof connected to the intermediate core portions 1030, and are in an exposed state.

CITATION LIST

Patent Literature

Patent Literature 1; Japanese Unexamined Patent Publication No. 2008-041880

SUMMARY OF INVENTION

Technical Problem

In recent years, a reduction in size and weight is desired for in-vehicle components for hybrid vehicles and the like, and a reduction in size is also desired for a reactor.

In order to reduce the size of the reactor disclosed by Patent Literature 1, it may be possible to structure each of the core pieces as a powder magnetic core having isotropy, and to deform, for example, part of the U-shaped core piece 103*u* as shown in FIG. 10(B). As shown in FIG. 10(A), a U-shaped core piece 104*u* is structured such that, in a state where the reactor 100 is installed, in the installed face (the bottom face in FIG. 10(A)) of the U-shaped core piece 103*u*, only the exposed portion where the coil 102 is not disposed projects further than the installed face of the intermediate core portions 1030. That is, the U-shaped core piece 104*u* is in an irregular shape having locally projecting portions.

In a case where the core unit including the U-shaped core pieces 104*u* each having the locally projecting portions as described above and the core unit 103 including the flat U-shaped core pieces 103*u* are structured to be identical in volume, the U-shaped core piece 104*u* having projecting portions can shorten the axial direction length of the coil than the flat U-shaped core piece 103*u*. Accordingly, the reactor including the U-shaped core pieces 104*u* having the projecting portions can reduce the projected area in the installed state as compared to the reactor 100.

However, the irregularly shaped core piece having locally projecting portions is difficult to precisely mold because of its complicated shape. Further, since the core piece is of a complicated shape, the stress acting on the mold assembly tends to become locally great, which tends to shorten the lifetime of the mold assembly. Further, since the shape of the mold assembly also becomes complicated, an increase in the costs of the mold assembly is invited.

In order to improve the moldability of the core piece, it may be possible to structure the U-shaped core piece 104*u* having the projecting portions with a plurality of members. For example, it may be possible to structure the U-shaped core piece 104*u* as an assembled product made up of a flat U-shaped core piece 103*u* and plate-like core pieces respectively structuring the projecting portions, or as an assembled product made up of three rectangular parallelepiped shaped core pieces. However, in this case, it means that a single irregularly shaped U-shaped core piece is formed of a plurality of core pieces. Hence, an increase in both the number of components and the number of assembly steps is invited.

Accordingly, an object of the present invention is to provide a reactor whose number of components is small and is excellent in assemblability.

Solution To Problem

The present invention achieves the object stated above by setting the shape of a portion of a core unit where a coil is not disposed to a particular shape, and disposing gap members at particular positions.

A reactor of the present invention includes: a coil including a pair of coil elements having their respective axes paralleled to each other; and a core unit having a pair of intermediate core portions around which the coil elements are respectively disposed. The core unit is formed to be annular by a combination of a plurality of magnetic core pieces and gap members each disposed between each ones of the magnetic core pieces. The magnetic core pieces are each structured with a powder magnetic core. The magnetic core pieces include at least one intermediate core piece structuring each of the intermediate core portions, and a pair of end core pieces disposed so as to clamp the intermediate core portions around which the coil elements are disposed, the pair of end core pieces having no coil disposed thereto. In the reactor, one of an installed face becoming an installed side when the reactor is installed and a face opposite to the installed face in each of the end core pieces projects further than one of an installed face becoming an installed side when the reactor is installed and a face opposite to the installed face in each of the intermediate core portions. Further, in the reactor, the end core pieces respectively include clamping faces that clamp the intermediate core portions disposed in parallel to each other, the clamping faces each being structured with a single plane. Still further, in the reactor, out of the gap members, at least one gap member is disposed between one of the end core pieces and the intermediate core piece. The relative permeability of this gap member is greater than 1.

In the reactor of the present invention, the core unit is structured such that each end core piece projects further than each intermediate core portion (each intermediate core piece). This structure allows the reactor of the present invention to shorten the axial direction length of the coil as compared to the reactor 100 having the core unit 103 with no projecting portions, in a case where the total volume of the magnetic core pieces included in the reactor of the present invention and the total volume of the magnetic core pieces included in the reactor 100 shown in FIG. 10(A) are set to be identical to each other. Accordingly, the reactor of the present invention can reduce the projected area in the installed state to be smaller than that of the reactor 100, and is small in size.

Further, the clamping faces clamping a pair of intermediate core portions 1030 disposed in parallel to each other are different from the conventional U-shaped core piece 103*u* which is structured with two planes being away from each other in the paralleled direction of the coil elements. The reactor of the present invention includes the end core pieces each having the clamping face being structured with a single plane, despite its being small in size as described above. That is, since each of the end core pieces included in the reactor of the present invention is not of an irregular shape but a simple three-dimensional shape, it can easily and precisely be molded. Further, the mold assembly for molding each of the end core pieces included in the reactor of the present invention can be of a simple shape, and hence long lifetime of the mold assembly can be expected.

Further, the reactor of the present invention is structured such that one of the gap members is disposed between each end core piece and the intermediate core pieces structuring each intermediate core portion. This structure allows the reactor of the present invention to reduce the total number of components of the core pieces and the gap members, despite the core unit having the projecting portions as described above. Accordingly, the reactor of the present invention can reduce the assembly steps, and hence is excellent in assemblability.

Further, the relative permeability of the gap member interposed between the end core piece and the intermediate core piece is greater than 1.

In general, what are used as the gap members of the core unit are members that have relative permeability being lower than that of the core pieces made of a magnetic material, and that can suppress magnetic saturation. In order to achieve such an effect, the upper limit of the relative permeability of the gap members is preferably equal to or smaller than 10.

As the gap members whose relative permeability is equal to or smaller than 10, what can be used is members made of a material generally called non-magnetic material (whose relative permeability is 1). Representative non-magnetic material is ceramic such as alumina. Since such ceramic exhibits excellent rigidity, a prescribed distance between the end core piece and the intermediate core pieces can easily be maintained. Further, since it exhibits excellent heat resistance, it can suitably be used at even a portion where the temperature tends to rise because of the coil being energized.

However, with the gap members made of a non-magnetic material, leakage fluxes tend to occur at the gap member portion. In particular, the leakage fluxes tend to occur between the end core piece exposed outside the coil generating the magnetic fluxes and the intermediate core piece connected to this end core piece. Accordingly, it is preferable that the gap member interposed between the end core piece and the intermediate core piece is magnetic to some extent. Specifically, the relative permeability of the gap member is preferably greater than 1. With this structure, the leakage fluxes can be suppressed. Such a magnetic gap member may be a member structured with resin mixed with magnetic powder. The magnetic powder is preferably made of a magnetic material whose relative permeability is high. Specifically, magnetic powder made of a magnetic material whose relative permeability is equal to or greater than 1000 is preferable. Exemplary magnetic material may be metallic materials such as Fe, Fe—Si alloy, Sendust (Fe—Si—Al alloy) and the like, and non-metallic materials such as ferrite and the like. The resin is preferably non-magnetic, and it may be unsaturated polyester, phenolic resin, epoxy resin, polyester, and polyphenylene sulfide (PPS) resin.

When the inductance of the reactor is constant, the greater the relative permeability of the gap members is, the greater the thickness of the gap members becomes. Accordingly, from the viewpoint of suppressing the leakage fluxes and the magnetic saturation of the core unit, and reducing the thickness of the gap members to thereby reduce the size of the reactor, it is preferable to appropriately select the relative permeability of the gap members. Specifically, the lower limit of the relative permeability of the gap members is preferably equal to or greater than 1.1. On the other hand, the upper limit of the relative permeability of the gap members is preferably equal to or smaller than 2.0, and is more preferably smaller than 1.5. In particular, as the reactor of the present invention, in a case where the core unit is structured such that each end core piece projects further than each intermediate core portion (each intermediate core piece), the relative permeability of the gap member is preferably equal to or greater than 1.2 and smaller than 1.5.

In addition, as described above, since the core unit is structured such that each end core piece projects further than each intermediate core portion (each intermediate core pieces) in the reactor of the present invention, magnetic fluxes that leak from the gap member interposed between the end core piece and the intermediate core piece can be reduced.

In one mode of the present invention, the installed face of each of the end core pieces and the face opposite to the installed face of each of the end core pieces project further than the installed face of each of the intermediate core portions and the face opposite to the installed face of each of the intermediate core portions.

With this structure, when the total volume of the magnetic core pieces is set to be identical, the axial direction length of the coil can further be shortened, and the projected area in the installed state can further be reduced, to achieve a further reduction in size. Further, an increase in the projecting portion projecting further from each intermediate core portion (each intermediate core piece) in each end core piece can further reduce the magnetic fluxes that leak from the gap member interposed between the end core piece and the intermediate core piece.

In one mode of the present invention, when the both intermediate core portions are disposed, an external periphery of the clamping face projects further than an outer side face of each of the intermediate core portions.

With this structure, an increase in the projecting portion in each end core piece projecting further than each intermediate core portion (each intermediate core piece) can reduce the magnetic fluxes that leak from the gap member interposed between the end core piece and the intermediate core piece. Note that, as used herein, the outer side face of each intermediate core portion refers to the face opposite to the face of one intermediate core portion facing the face of the other intermediate core portion. Here, in a case where the installed face becoming an installed side when the reactor is installed and the face opposite to the installed face in each of the end core piece project further than the installed face becoming the installed side when the reactor is installed and the face opposite to the installed face in each of the intermediate core portion, and where the external periphery of each clamping face projects further than the outer side face of each intermediate core portion when the intermediate core portions are disposed, the clamping face of each end core piece includes an inner regions that face the end faces of the intermediate core portions and an outer region surrounding the entire circumference of the inner region.

Advantageous Effects of Invention

The reactor of the present invention is made up of a small number of components and exhibits excellent assemblability, despite its being small in size.

DESCRIPTION OF EMBODIMENTS

Figure 1:
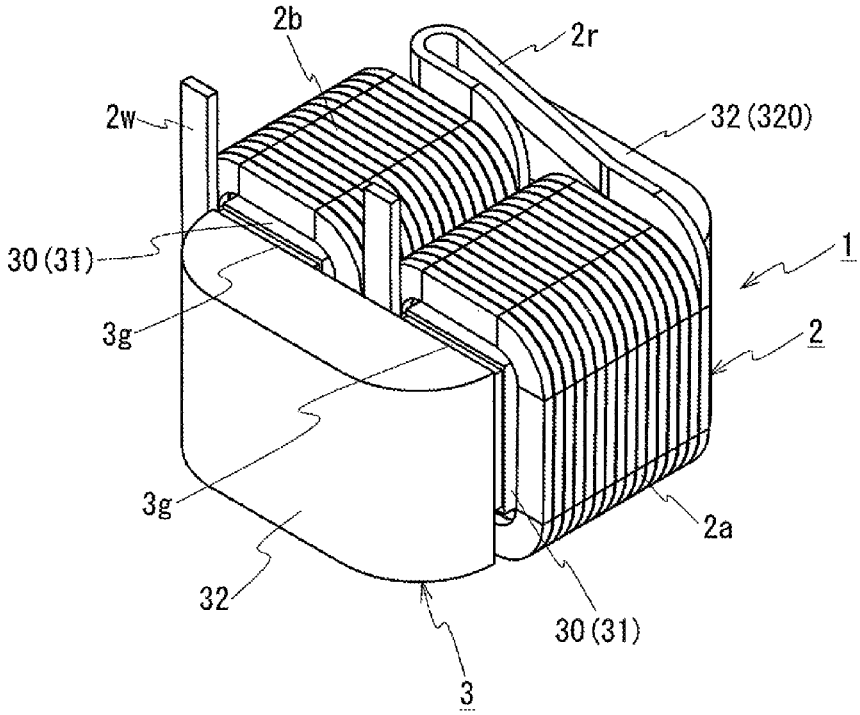
FIG. 1 is a perspective view showing the schematic structure of a reactor according to a first embodiment.

In the following, with reference to the drawings, a reactor according to each of embodiments of the present invention will be described. In the drawing, identical reference symbols denote identical elements.

First Embodiment

In the following, with reference to FIGS. 1 and 2, a description will be given of a reactor 1 according to a first embodiment. The reactor 1 is a circuit component which is used as being installed onto a fixation target such as a metal-made (representatively, aluminum-made) cooling base (not shown) having therein a coolant circulation path. The reactor 1 includes a coil 2 having a pair of coil elements 2*a* and 2*b*, and a core unit 3 having a pair of intermediate core portions 30 where the coil elements 2*a* and 2*b* are respectively disposed. The core unit 3 is formed to be annular by combining a plurality of magnetic core pieces (intermediate core pieces 31 and end core pieces 32) and gap members 3*g*, the gap members 3*g* each being interposed between each ones of the magnetic core pieces. The reactor 1 is characterized in the shape of the core unit 3 and a disposition manner of the gap members 3*g*. In the following, their respective structures will be described further in detail.

[Coil]

The coil 2 includes a pair of coil elements 2*a* and 2*b* made of a single continuous wire 2*w* being spirally wound, and a couple portion 2*r* formed by part of the wire 2*w* being folded back to couple the coil elements 2*a* and 2*b* to each other. The coil elements 2*a* and 2*b* are paralleled such that their respective axes are in parallel to each other. The wire 2*w* is suitably a coated wire provided with an insulating coated layer around the outer circumference of the conductor. Here, what is used is a coated rectangular wire in which the conductor is a copper-made rectangular wire and the insulating coated layer is enamel. The coil elements 2*a* and 2*b* are each an edgewise coil formed by the coated rectangular wire being wound edgewise. The wire is not limited to those whose conductor is a rectangular wire, and wires of various shapes whose cross section is circular, polygonal and the like may be used. The material or thickness of the insulating coated layer can appropriately be selected.

Note that, it may also be possible to use a coil in which coil elements are made of separate wires, and the ends of wires forming respective coil elements are joined to each other by welding or the like to be integrated.

The opposite end portions of the wire 2*w* are appropriately drawn out from the turn forming portion, and to each of the conductor portions exposed by the insulating coated layer being peeled off, a terminal member (not shown) made of a conductive material is connected. To the terminal members, an external apparatus (not shown) such as a power supply that supplies the coil 2 with power is connected. In order to connect between the conductor portions of the wire 2*w* and the terminal members, welding such as TIG welding can be used.

[Core Unit]

<<Overall Structure>>

A description will be given of the core unit 3 with reference to FIG. 2 as appropriate. The core unit 3 includes a plurality of intermediate core pieces 31 as its constituent elements, and as described above, the core unit 3 includes a pair of rectangular parallelepiped intermediate core portions 30 around which the coil elements 2*a* and 2*b* are respectively disposed, a pair of end core pieces 32 around which the coil 2 is not disposed and hence exposed, and a plurality of gap members 3*g* each disposed between each ones of the core pieces. The core unit 3 is formed to be closed loop-like (annular) by the pair of end core pieces 32 being disposed to clamp the pair of intermediate core portions 30, which are disposed to be paralleled such that their respective axes are in parallel to each other.

<<Material>>

The intermediate core pieces 31 and the end core pieces 32 are each a powder magnetic core obtained by subjecting powder of soft magnetic material such as iron or steel containing iron to pressurized molding, and thereafter to heat treatment as appropriate. The gap members 3*g* are each a plate-like member disposed at a clearance between each ones of the core pieces for adjusting the inductance of the reactor 1. Here, each gap member 3*g* is made of a resin mixed with magnetic powder, and relative permeability thereof is greater than 1.

Out of the plurality of gap members 3*g*, in particular, a gap member 3*g* interposed between the end core piece 32 and the intermediate core piece 31 has relative permeability greater than 1 and equal to or smaller than 10. The gap members 3*g* can be manufactured by mixing magnetic powder (e.g., Fe powder) and resin powder made of a non-magnetic resin (e.g., unsaturated polyester), and subjecting to pressurized molding to be plate-like. By adjusting the content of the magnetic powder in the gap members 3*g*, relative permeability of each of the gap members 3*g* can be adjusted. For example, in a case where the magnetic powder is Fe powder and the non-magnetic resin is unsaturated polyester, when a gap member 3*g* contains magnetic powder by 10 mass percent (2.5 volume percent), the relative permeability of the gap member 3*g* is approximately 1.15. Further, when a gap member 3*g* contains magnetic powder by 27 mass percent (6.8 volume percent), the relative permeability of the gap member 3*g* is approximately 1.5.

<<Intermediate Core Portion>>

The intermediate core portions 30 are each an assembled product in which the rectangular parallelepiped shape intermediate core pieces 31 and the gap members 3*g* are alternately disposed and integrally joined by an adhesive agent. Here, the intermediate core portions 30 are each made up of three intermediate core pieces 31 and two gap members 3*g*. The number of the magnetic core pieces and the number of the gap members structuring each intermediate core portion can be selected as appropriate in accordance with the inductance of the reactor 1. For example, what can be employed is a structure in which each intermediate core portion is structured with a single intermediate core piece without gap members. Further, the intermediate core pieces structuring the intermediate core portions may be different from each other in number.

<<End Core Piece>>

Figure 2A:
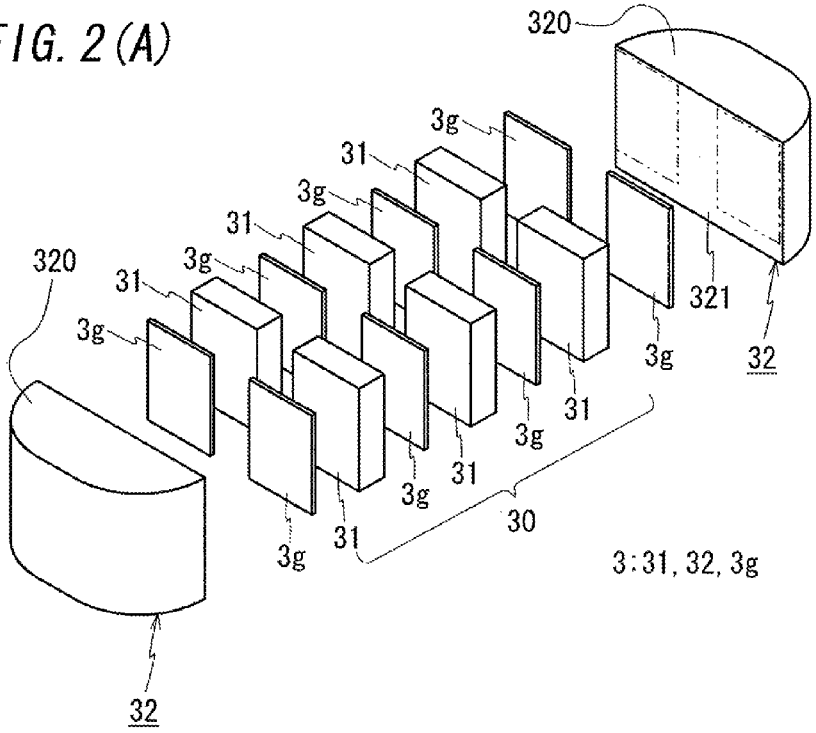
FIG. 2(A) is an exploded perspective view of a core unit included in the reactor according to the first embodiment.

The end core pieces 32 are each a prism element, in which a pair of opposite faces is in a trapezoidal shape. In each of the end core pieces 32, the face connecting between the bottom sides of the pair of trapezoidal faces 320 is a clamping face 321 that clamps a pair of intermediate core portions 30 disposed in parallel as described above. As shown in FIG. 2(A), this clamping face 321 is structured with a single plane. Note that, though each end core piece 32 has a curved shape in which the corner portions on the top side of the trapezoidal face 320 are rounded, it may have a shape made up of a combination of flat planes.

<<Shape of Core Unit>>

Figure 2B:
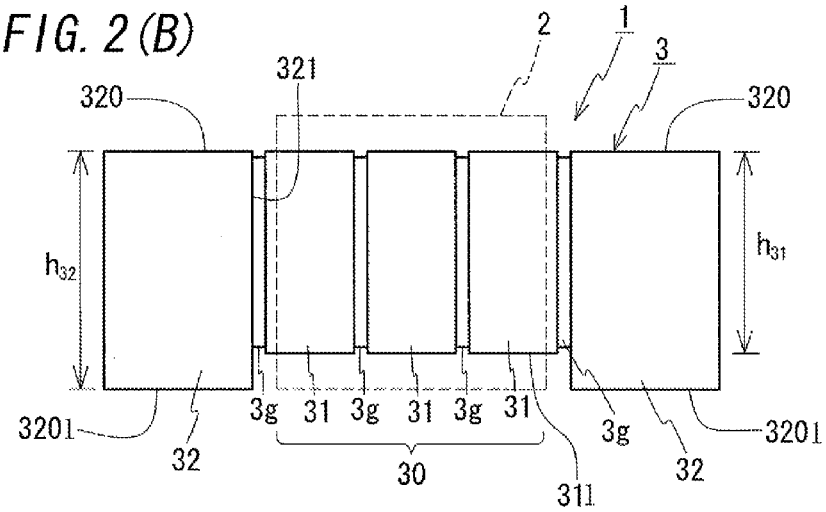
FIG. 2(B) is a front view schematically showing the reactor according to the first embodiment.

One of the characteristics of the reactor 1 lies in that, as shown in FIG. 2(B), an installed face 320*l* of each end core piece 32 which becomes the installed side in a state where the reactor 1 is installed onto the fixation target projects further than an installed face of the intermediate core portion 30 (mainly, an installed face 31*l* of each of the intermediate core pieces 31) which becomes the installed side. That is, a height $h_{32}$ of the end core piece 32 (in a state where the reactor 1 is installed, the dimension in the direction (the top-bottom direction in FIG. 2(B)) perpendicular to the axial direction of the coil 2 (the right-left direction in FIG. 2(B))) is higher than a height $h_{31}$ of the intermediate core piece 31.

Here, the intermediate core portions 30 and the end core pieces 32 are combined such that the faces of the intermediate core pieces 31 opposite to the installed faces 31*l* and the faces of the end core pieces 32 opposite to the installed faces (each being the top faces in FIG. 2(B)) become flush with each other. In this state, the height $h_{32}$ of each end core piece 32 and the height $h_{31}$ of each intermediate core piece 31 are adjusted such that the difference $h_{32}-h_{31}$ becomes as great as the width of the wire structuring the coil 2. By setting the difference $h_{32}-h_{31}$ to be as great as the width of the wire, as shown in FIG. 2(B), the installed faces 320*l* of the end core pieces 32 and the installed face of the coil 2 become flush with each other when the coil 2 and the core unit 3 are combined. Note that the difference between the heights $h_{31}$ and $h_{32}$ can appropriately be selected. Further, in each end core piece, the face opposite to the installed face may also be further projected than the intermediate core portions.

<<Between Intermediate Core Portion and End Core Piece>>

Further, one of the characteristics of the reactor 1 lies in that a gap member 3*g* is interposed between each end core piece 32 and each intermediate core portion 30.

Here, what is employed is the structure in which a gap member 3*g* is joined to each of the opposite end faces of the intermediate core portions 30. However, it is also possible to employ a structure in which a gap member is joined only to one end face of each of the intermediate core portions 30, or a structure in which a gap member is joined to one end face or opposite end faces of only one of the intermediate core portions. The number of the gap member to be interposed between the end core piece and the intermediate core piece can appropriately be selected such that the reactor 1 achieves desired inductance.

Note that, when an adhesive agent (non-magnetic material) is to be used to join the magnetic core pieces and the gap members, the thickness can extremely be reduced so as not to substantially affect adjustment of the inductance. Further, each of the magnetic core pieces can be structured with a plurality of further divided pieces, to obtain a structure in which the divided pieces are combined using an adhesive agent or fixing tools. In this case, it is preferable that, in a case where the magnetic core piece is structured with a plurality of divided pieces being divided in the plane direction (i.e., the direction crossing the magnetic fluxes that flow when the reactor is completed, e.g., the right-left direction in FIG. 2(B)), the thickness of the adhesive agent is extremely reduced to bring the divided pieces into contact with one another as closely as possible to thereby eliminate any clearance between the divided pieces, so that adjustment of inductance will not substantially be affected. On the other hand, in a case where the magnetic core piece is structured with a plurality of divided pieces being divided in the height direction (i.e., the direction in parallel to the magnetic fluxes that flow when the reactor is completed, e.g., the top-bottom direction in FIG. 2(B)) also, it is preferable to extremely reduce the thickness of the adhesive agent so as to bring the divided pieces into contact with one another as closely as possible.

[Assembly of Reactor]

The reactor 1 having the structure described above can be formed as follows, for example. First, the intermediate core pieces 31 and the gap members 3*g* are alternately joined to form two intermediate core portions 30. Then, an additional gap member 3*g* is joined also to each of the opposite end faces of the intermediate core portions 30. Next, to one end face of the intermediate core portions 30, one end core piece 32 is joined, to form a]-shaped (square-bracket shaped) member. To the intermediate core portions 30 of the]-shaped (square-bracket shaped) member, the coil elements 2*a* and 2*b* of the coil 2 separately prepared are disposed. Then, to the other end faces of the intermediate core portions 30, the other end core piece 32 is joined. Through the foregoing steps, the reactor 1 can be obtained. The reactor 1 is used as being fixed onto a cooling base by using an appropriate fixing member.

[Other Structure]

In order to enhance insulation between the coil 2 and the core unit 3, what may be employed is a mode in which an insulator made of an insulating material (e.g., polyphenylene sulfide (PPS) resin, polytetrafluoroethylene (PTFE) resin, liquid crystal polymer (LCP) or the like) is disposed at the outer circumference of the portion in the core unit 3 where the coil 2 may be brought into contact with. The insulator may be in a mode that includes, e.g., a sleeve-like portion covering the outer circumference of each of the intermediate core portions 30, and frame-like portions disposed between the intermediate core portions 30 and the end core pieces 32.

Alternatively, in place of the insulator, the inner circumference and the outer circumference of the coil elements may be covered by an insulating resin (e.g., epoxy resin, polyphenylene sulfide (PPS) resin, liquid crystal polymer (LCP) or the like) to obtain a coil molded product. In this case, since the insulator can be dispensed with, a further reduction in the number of components and a further improvement in assemblability of the reactor can be achieved. Further, by previously preparing the intermediate core portions, and integrally molding the intermediate core portions and the coil with the insulating resin, to thereby obtain a coil molded product provided with the intermediate core portions, the assemblability of the reactor can further be improved.

Further, though the reactor 1 can be used as it is, when it is in a mode including an external resin portion that covers the outer circumference of the combined product of the coil 2 and the core unit 3, the combined product can mechanically be protected and can be protected from the environment. A structure in which the face on the installed side of the combined product is not covered by the external resin portion and the face of the installed side is directly brought into contact with the cooling base exhibits excellent heat dissipating characteristic.

As the resin structuring the external resin portion, e.g., epoxy resin, urethane resin, polyphenylene sulfide (PPS) resin, polybutylene terephthalate (PBT) resin, acrylonitrile butadiene styrene (ABS) resin, unsaturated polyester or the like can be used. Use of the structuring resin further containing therein filler made of at least one ceramic selected from a group consisting of silicon nitride, alumina, aluminum nitride, boron nitride, and silicon carbide can further enhance the heat dissipating characteristic.

Alternatively, the reactor 1 may be stored in a case made of a metallic material such as aluminum and aluminum alloy, or magnesium and magnesium alloy, and inside of the case may be sealed with resin. The metallic material is preferably non-magnetic. Further, as the sealing resin, urethane resin, epoxy resin, silicone resin or the like can be used. Further, the case may be formed with a non-metallic material such as resin, e.g., polybutylene terephthalate (PBT) resin, urethane resin, polyphenylene sulfide (PPS) resin, acrylonitrile butadiene styrene (ABS) resin or the like. Since non-metallic materials in general exhibit an excellent electrical insulating characteristic, insulation between the coil 2 and the case can be enhanced. Further, since the non-metallic materials are lighter in specific gravity than the metallic materials, and a reduction in weight can be expected. By mixing the filler made of the ceramic noted above with the resin, an improvement in heat dissipating characteristic can be expected. In a case where the case is formed with such resin, injection molding can suitably be used.

Further, in the modes where the external resin portion or the sealing resin is provided, the ends of the wire 2*w* of the coil 2 are exposed from the resin, so that the terminal members can be connected thereto.

<Application>

The reactor 1 can be used as a constituent component of, e.g., an in-vehicle converter of an electrically driven vehicle such as a hybrid vehicle, an electric vehicle, a fuel cell vehicle or the like. When the reactor 1 is used for such an application, it should be designed such that the conduction conditions are: the maximum current (DC) is approximately 100 A to 1000 A; the average voltage is approximately 100 V to 1000 V; and the working frequency is approximately 5 kHz to 100 kHz, and that the following specification is satisfied.

inductance: 10 μH to 1 mH volume: 200 $cm^3$ to 1000 $cm^3$

<Effect>

Figure 10A:
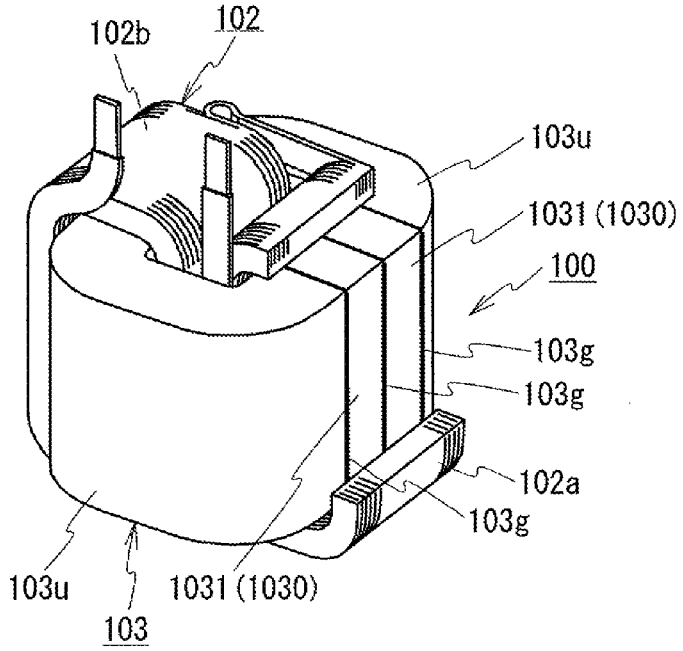
FIG. 10(A) is a perspective view showing the schematic structure of a conventional reactor.

As described above, the reactor 1 is in a shape in which the installed faces 320*l* of the end core piece 32 project further than the installed faces 31*l* of the intermediate core portions 30 (the intermediate core pieces 31). With this structure, the reactor 1 can achieve a reduction in the axial direction length of the coil when the total volume of the magnetic core pieces of the reactor 100 shown in FIG. 10(A) and the total volume of the magnetic core pieces of the reactor 1 are set to be identical to each other. Accordingly, the reactor 1 is small in the projected area in the installed state and is small in size.

Figure 10B:
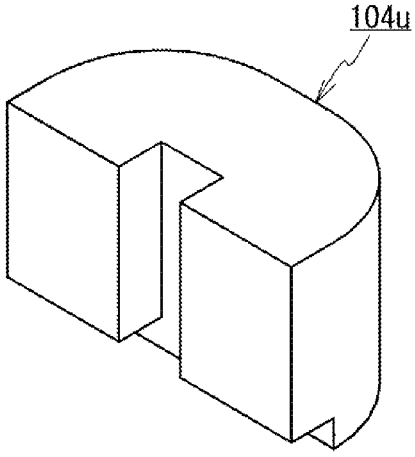
FIG. 10(B) is a perspective view of an irregularly shaped U-shaped core piece.

Further, the reactor 1 is in a shape in which the height $h_{32}$ of the end core pieces 32 and the height $h_{31}$ of the intermediate core pieces 31 structuring the intermediate core portions 30 are differed from each other, such that the core unit 3 is partially projected. Further, the reactor 1 is structured such that a gap member 3*g* is disposed between each end core piece 32 and each intermediate core portion 30. With this structure, despite the reactor 1 being in a shape in which the core unit 3 is partially projected, the clamping faces 321 of the end core pieces 32 that clamp a pair of intermediate core portions 30 being paralleled can be formed as a single plane. Accordingly, as compared to the irregularly shaped U-shaped core piece 104*u* shown in FIG. 10(B), the end core piece 32 is of a simple shape and can easily be molded, and hence being excellent in manufacturability. Further, the entire magnetic core pieces of the reactor 1 including the end core pieces 32 are of a simple shape, and hence the reactor 1 is excellent in manufacturability. In this manner, since each magnetic core piece is of a simple shape, a mold assembly for molding can be of a simple shape. Thus, manufacturing is facilitated and a long lifetime of the mold assembly can be expected.

Further, employing the structure in which a gap member 3*g* is interposed between each end core piece 32 and each intermediate core portion 30, the reactor 1 can reduce the number of components, and hence is excellent in assemblability. The reactor 1 according to the first embodiment includes 3×2 pieces of the intermediate core pieces and two pieces of the end core pieces, and the total number of the magnetic core pieces is eight.

On the other hand, for example, the following discusses a case in which a core unit in a partially projected shape as the core unit 3 of the reactor 1 according to the first embodiment is structured with a pair of U-shaped core pieces, intermediate core pieces whose height is shorter than the U-shaped core pieces, and a total of eight gap members (this core unit will be referred to as a comparative core). Then, in order to set the U-shaped core pieces each into an irregularly shaped core piece 104*u* shown in FIG. 10(B), a pair of intermediate core pieces must be joined to each of the U-shaped core pieces. Accordingly, with the comparative core, the intermediate core pieces increases by four pieces in total, and the total number of the magnetic core pieces becomes twelve. In this manner, with the comparative core, the number of components is greater than that of the reactor 1 according to the first embodiment.

Further, since the gap member 3*g* interposed between the end core piece 32 and the intermediate core piece 31 is made of resin mixed with magnetic powder, and whose relative permeability is greater than 1, the leakage fluxes between the end core piece 32 and the intermediate core portion 30 where leakage fluxes tend to occur can effectively be reduced. Note that, though it has been described herein that the other gap members 3*g* except for the gap member 3*g* interposed between the end core piece 32 and the intermediate core piece 31 are also made of resin mixed with magnetic powder, the other gap members 3*g* may be made of non-magnetic material (relative permeability: 1).

Further, since the core unit 3 is structured such that the end core pieces 32 project further than the intermediate core portions 30 (the intermediate core pieces 31), the magnetic fluxes that leak from the gap member 3*g* interposed between the end core piece 32 and the intermediate core piece 31 can be reduced.

Further, in connection with the reactor 1, since the installed faces 320*l* of the end core pieces 32 and the installed face of the coil 2 are flush with each other, the reactor 1 can easily be stabilized when it is installed. Further, since the coil 2 and the core unit 3 are directly supported by the cooling base, an excellent heat dissipating characteristic can be achieved.

In the first embodiment, the mode in which the installed faces 320*l* of the end core pieces 32 project further than the installed faces 31*l* of the intermediate core portions 30 (the intermediate core pieces 31) has been described. However, with reference to FIG. 2 for the sake of convenience, conversely to the mode shown in FIG. 2, the faces of the end core pieces 32 opposite to the installed faces 320*l* may project further than the installed faces 31*l* of the intermediate core portions 30 (the intermediate core pieces 31), and the installed faces 320*l* of the end core pieces 32 may not project further from the installed faces 31*l* of the intermediate core portions 30 (the intermediate core pieces 31). Further, both the installed faces 320*l* and the opposite faces of the end core pieces 32 may project from the installed faces 31*l* and the opposite faces of the intermediate core portions 30 (the intermediate core pieces 31). In this case, when the total volume of the magnetic core pieces is set to be identical, the axial direction length of the coil can further be shortened, and the projected area in the installed state can further be reduced, to achieve a further reduction in size. Further, in each end core piece, an increase in the projecting portion projecting further than the intermediate core portions (the intermediate core pieces) can further reduce the magnetic fluxes leaking from the gap member interposed between the end core piece and the intermediate core piece.

Second Embodiment

Figure 3:
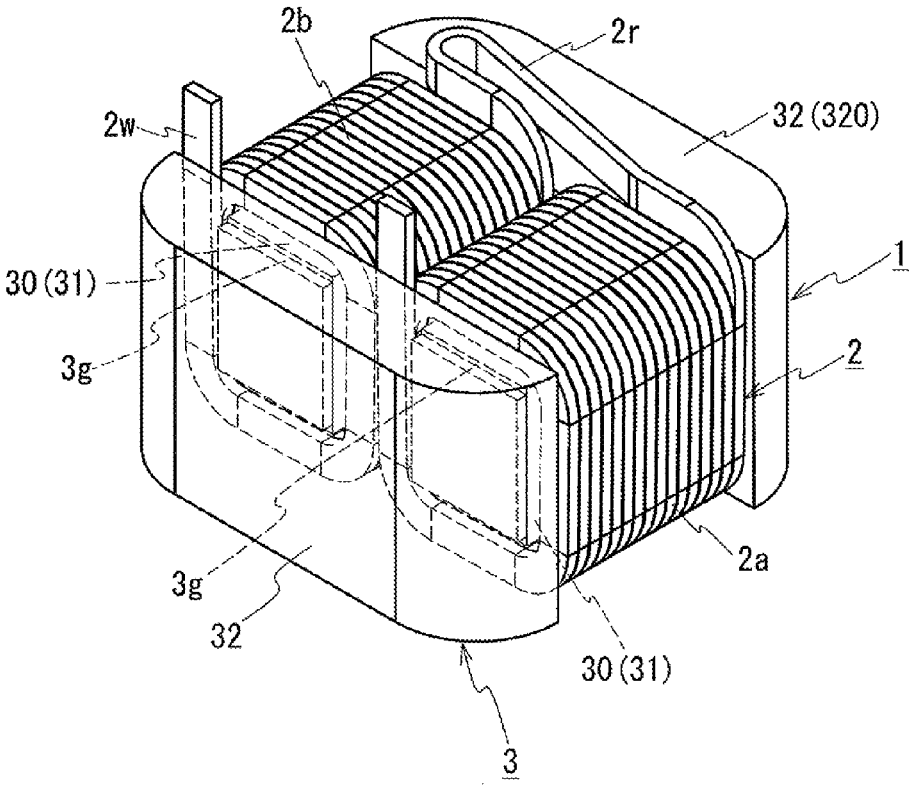
FIG. 3 is a perspective view showing the schematic structure of a reactor according to a second embodiment.

In a second embodiment, with reference to FIGS. 3 to 5, a description will be given of a mode in which the external periphery of each clamping face of each end core piece projects further than the outer side face of each intermediate core portion. Note that, the description will mainly be given of the difference from the first embodiment whose description has been given with reference to FIGS. 1 and 2, and similar points will not be repeated.

Figure 4:
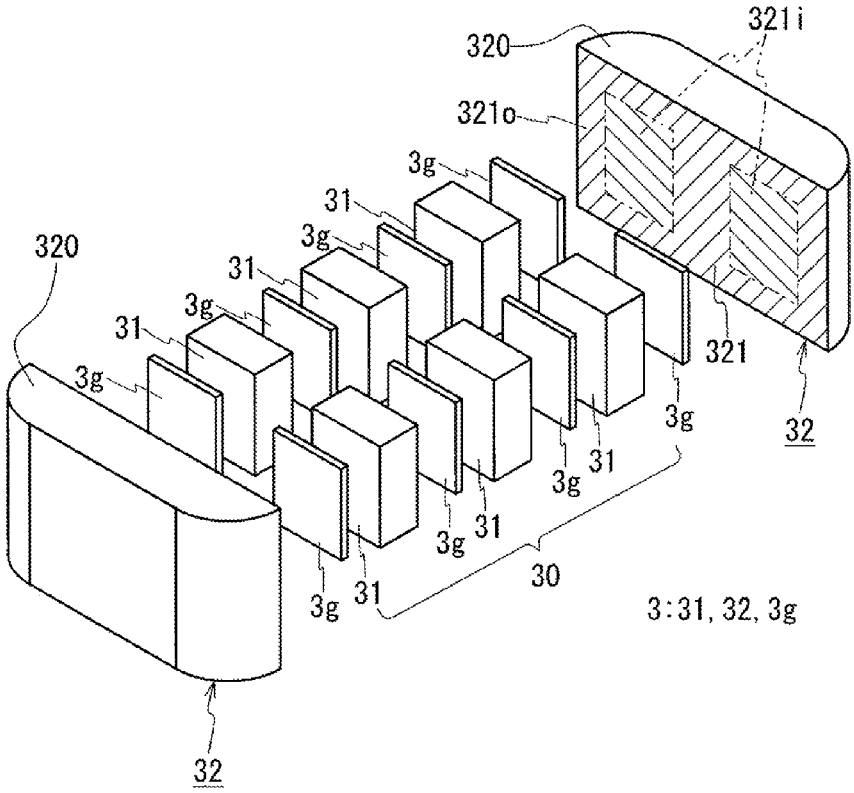
FIG. 4 is an exploded perspective view of a core unit included in the reactor according to the second embodiment.
Figure 5A:
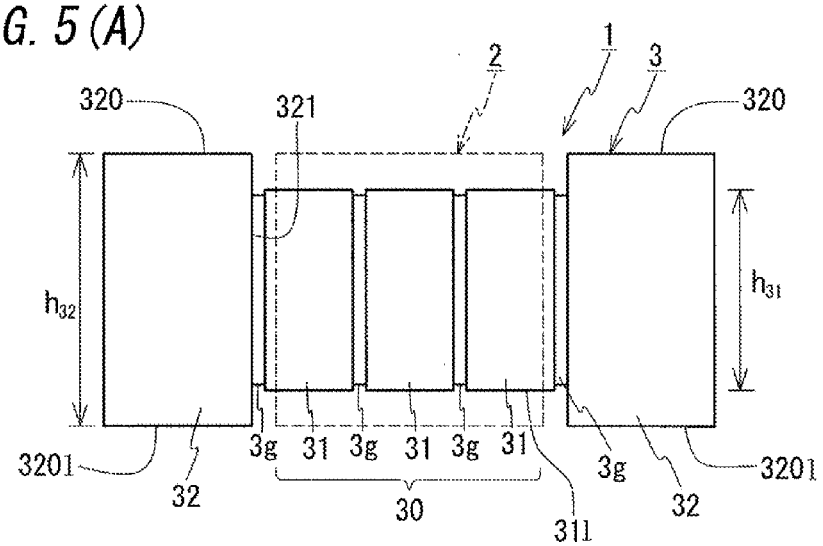
FIG. 5(A) is a front view schematically showing the reactor according to the second embodiment.
Figure 5B:
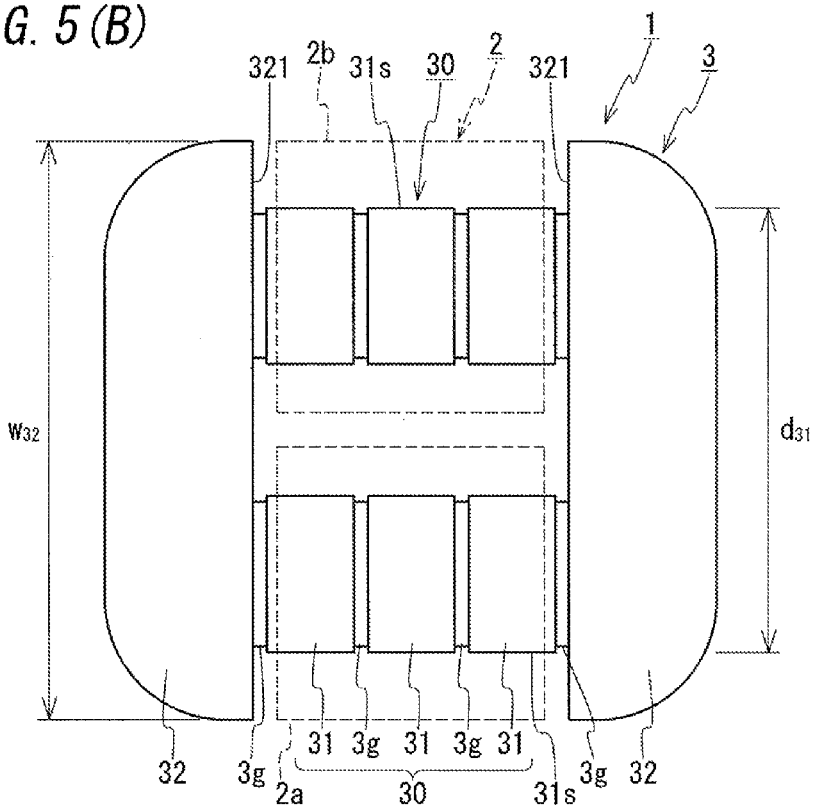
FIG. 5(B) is a plan view schematically showing the reactor according to the first embodiment.

As shown in FIG. 4, a clamping face 321 of each end core piece 32 is formed with a single plane. One of the characteristics of the reactor 1 lies in that, as shown in FIG. 5(A), an installed face 320*l* of each end core piece 32 that becomes the installed side in a state where the reactor 1 is installed onto the fixation target and a face opposite to the installed face project further than an installed face of the intermediate core portion 30 that becomes the installed side (mainly, the installed faces 31*l* of the intermediate core pieces 31) and a face opposite to the installed face. Further, as shown in FIG. 5(B), one of the characteristics of each end core piece 32 lies in that, the external periphery of the clamping face 321 projects further than the outer side faces of the intermediate core portions 30 (mainly, outer side faces 31*s* of the intermediate core pieces 31). That is, a height $h_{32}$ of the end core piece 32 (in a state where the reactor 1 is installed, the dimension in the direction (the top-bottom direction in FIG. 5(A)) perpendicular to the axial direction of the coil 2 (the right-left direction in FIG. 5(A))) is higher than a height $h_{31}$ of the intermediate core piece 31. Further, a width $w_{32}$ of the end core piece 32 (in a state where the reactor 1 is installed, the dimension in the direction (the top-bottom direction in FIG. 5(B)) perpendicular to the axial direction of the coil 2 (the right-left direction in FIG. 5(B))) is wider than a distance $d_{31}$ from the outer side face 31*s* of one intermediate core piece 31 out of the intermediate core portions 30 to the outer side face 31*s* of the other intermediate core piece 31. Accordingly, as shown in FIG. 4, the clamping face 321 of each end core piece 32 has inner regions 321*i* (shown by diagonally right down hatches in FIG. 4) that face the end faces of the intermediate core portions 30, and an outer region 321*o* (shown by diagonally right up hatches in FIG. 4) that surrounds the entire circumference of both the inner regions.

Here, the height $h_{32}$ and the width $w_{32}$ of each end core piece 32 (the clamping face 321) are adjusted such that the width (see FIG. 4) of the outer region 3210 surrounding the entire circumference of both the inner regions 321*i* in the clamping face 321 of each end core piece 32 becomes as great as the width of the wire structuring the coil 2. That is, when the coil 2 and the core unit 3 are combined with each other, the entire faces of the opposite end faces of the coil elements 2*a* and 2*b* face the outer region 3210 of the clamping face 321 of each end core piece 32. That is, as shown in FIG. 5 (A), the installed face 3201 of each end core piece 32 and the installed face of the coil 2, as well as the face opposite to the installed face 3201 of the end core piece 32 and the face opposite to the installed face of the coil 2 are flush with one another. Further, as shown in FIG. 5 (B), the external periphery of the clamping face 321 and the outer side face of the coil 2 (the faces of respective coil elements 2*a* and 2*b* which are opposite to the faces facing each other) become flush with each other. Accordingly, in an assembled product made up of the coil 2 and the core unit 3, a projection portion in terms of appearance can be reduced (see FIG. 3). Note that, the height $h_{32}$ and the width $w_{32}$ of each end core piece 32 (the clamping face 321) can appropriately be selected.

According to the second embodiment, an increase in the projecting portion in each end core piece projecting further than each intermediate core portion (each intermediate core piece) can further reduce the magnetic fluxes leaking from the gap member interposed between the end core piece and the intermediate core piece.

Other Embodiment 1

In the first and second embodiments, though the modes have been described in which the gap members included in the core unit are all made of resin mixed with magnetic powder (i.e., having a relative permeability of greater than 1), any gap members 3*g* can be made of alumina (i.e., having a relative permeability of 1).

<Relationship Between Relative Permeability of Gap Member and Loss>

(Simulation A)

Figure 6:
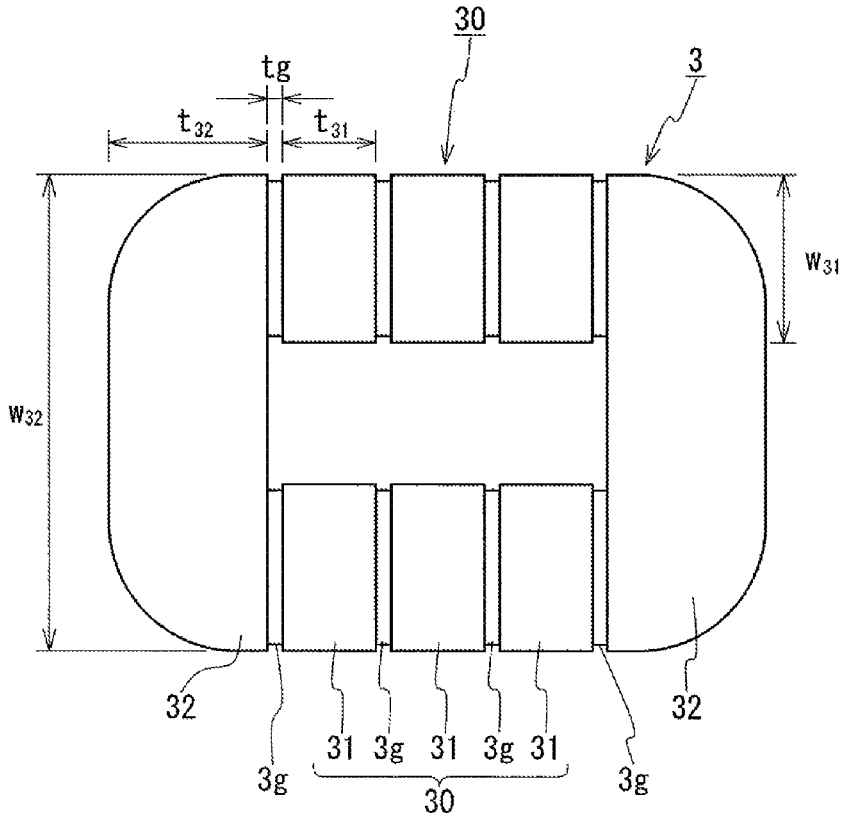
FIG. 6 is a diagram describing a core unit included in a reactor used for a simulation.

In Simulation A, the relationship between the relative permeability of the gap members and the copper loss was examined by a simulation using magnetic field analysis software as to the reactor according to the first embodiment. Here, what was employed was the analysis model was ¼ model (i.e., a model being divided into a quarter to be subjected to a simulation), and the size and the like of the core unit structuring the reactor were set as follows (see FIGS. 5 and 6).

Each of the end core pieces 32 was set to have a height $h_{32}$ of 40 mm, a thickness $t_{32}$ of 18 mm, and a width $w_{32}$ of 60 mm. Each of the intermediate core pieces 31 structuring the intermediate core portions 30 was set to have: a height $h_{31}$ of 30 mm, a thickness $t_{31}$ of 15 mm, and a width $w_{31}$ of 24 mm. The relative permeability of each core piece was set to 200. On the other hand, in connection with the coil 2, the number of turns of the coil elements 2*a* and 2*b* was 24. Further, the gap members 3*g* included in the core unit 3 were identical to one another.

Then, with the conduction conditions in which the current (AD) is 40 Ap-p and the frequency is 10 kHz, a thickness tg and copper loss per gap member were obtained when the relative permeability of each gap member 3*g* was varied in a range of 1.0 to 2.0 such that an inductance of approximately 125 μH was obtained. Further, the loss reduction rate to the copper loss with a relative permeability of 1.00 was obtained. The result is shown in Table 1.

TABLE 1

| Gap member | | | Loss reduction |
|---|---|---|---|
| Relative permeability | Thickness tg (mm) | Copper loss (W) | rate (%) |
| 1.00 | 2.000 | 18.7785 | — |
| 1.10 | 2.180 | 18.7353 | 0.230 |
| 1.20 | 2.360 | 18.5219 | 1.366 |
| 1.50 | 2.880 | 18.0838 | 3.699 |
| 2.00 | 3.760 | 17.1927 | 8.445 |

(Simulation B)

In Simulation B, the relationship between the relative permeability of the gap member and copper loss was examined in the same manner as in Simulation A, as to a reactor in a mode in which the installed faces 320*l* of the end core pieces 32 do not project further than the installed faces 31*l* of the intermediate core portions 30 (the intermediate core pieces 31) (hereinafter referred to as Reference Mode 1). The structure of the reactor of Reference Mode 1 is identical to the reactor according to the first embodiment except that each end core piece has no projecting portion that projects further than each intermediate core portion (each intermediate core piece) (i.e., the installed face of the end core pieces and the installed faces of the intermediate core portions (intermediate core pieces) are flush with each other). Here, the size and the like of the core unit structuring the reactor are set as follows.

Each of the end core pieces 32 was set to have a height $h_{32}$ of 30 mm; a thickness $t_{32}$ of 22 mm; and a width $w_{32}$ of 50 mm. Each of the intermediate core pieces 31 structuring the intermediate core portions 30 was set to have: a height $h_{31}$ of 30 mm; a thickness $t_{31}$ of 18 mm; and a width $w_{31}$ of 22 mm. The relative permeability of each core piece was set to 200. On the other hand, in connection with the coil 2, the number of turns of the coil elements 2*a* and 2*b* was 24. Further, the gap members 3*g* included in the core unit 3 were identical to one another.

Then, with the conduction conditions in which the current (AD) is 40 Ap-p and the frequency is 10 kHz, a thickness tg and copper loss per gap member were obtained when the relative permeability of each gap member 3*g* was varied in a range of 1.0 to 2.0 such that an inductance of approximately 182 μH was obtained. Further, the loss reduction rate to the copper loss with a relative permeability 1.00 was obtained. The result is shown in Table 2.

TABLE 2

| Gap member | | | Loss reduction |
|---|---|---|---|
| Relative permeability | Thickness tg (mm) | Copper loss (W) | rate (%) |
| 1.00 | 2.000 | 11.7850 | — |
| 1.05 | 2.095 | 11.7534 | 0.268 |
| 1.10 | 2.190 | 11.7231 | 0.525 |
| 1.20 | 2.380 | 11.6455 | 1.184 |
| 1.50 | 2.940 | 11.3560 | 3.640 |
| 2.00 | 3.860 | 10.7346 | 8.913 |

From the result of Simulations A and B, it can be seen that an increase in relative permeability of the gap member reduces copper loss. It can be understood that the loss caused by the leakage fluxes of the core unit is influencing, and it is considered that the relative permeability of the gap member is preferably greater than 1, and more preferably, equal to or greater than 1.1. However, the greater the relative permeability of the gap member is, the greater the thickness of the gap member becomes. Therefore, from the viewpoint of reducing the size of the reactor, it is considered that the relative permeability of the gap member is preferably equal to or smaller than 2, and more preferably smaller than 1.5.

<Discussion of Leakage Fluxes at Gap Member in Core Unit>

As described above, in connection with the reactor of the present invention, the clamping face of each end core piece is structured with a single plane, and each end core piece has a projecting portion projecting further than each intermediate core portion (each intermediate core piece). Further, a gap member is disposed between the end core piece and the intermediate core piece. FIG. 7 schematically shows the magnetic fluxes flowing through the core unit in the reactor according to the first embodiment (in the drawing, dashed line arrows represent the flow of the magnetic fluxes).

Figure 7A:
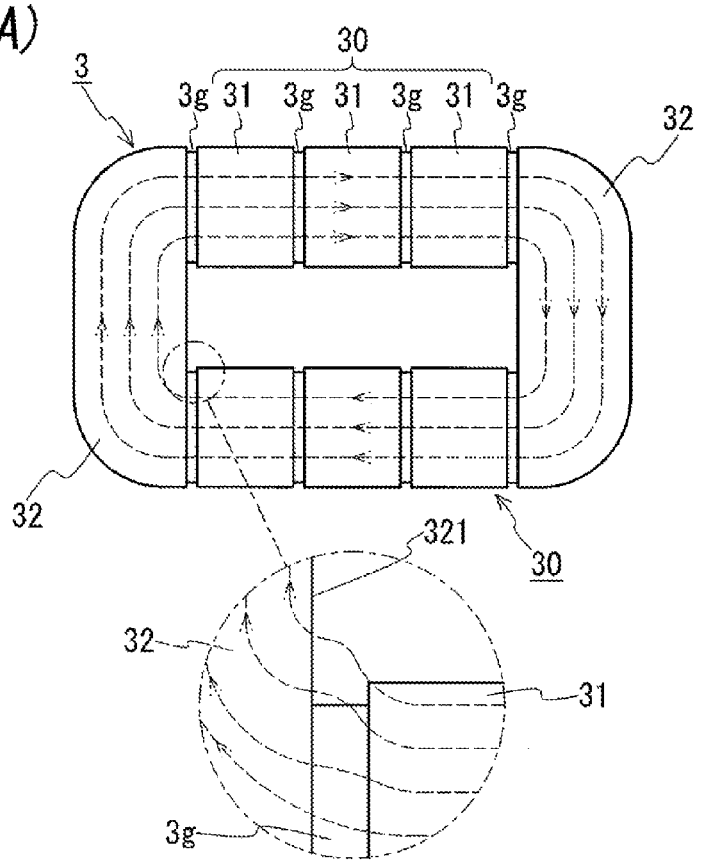
FIG. 7 is a diagram describing leakage fluxes at a gap member in the reactor according to the first embodiment, where (A) is a plan view and a partial enlarged view thereof, and (B) is a front view and a partial enlarged view thereof.
Figure 7B:
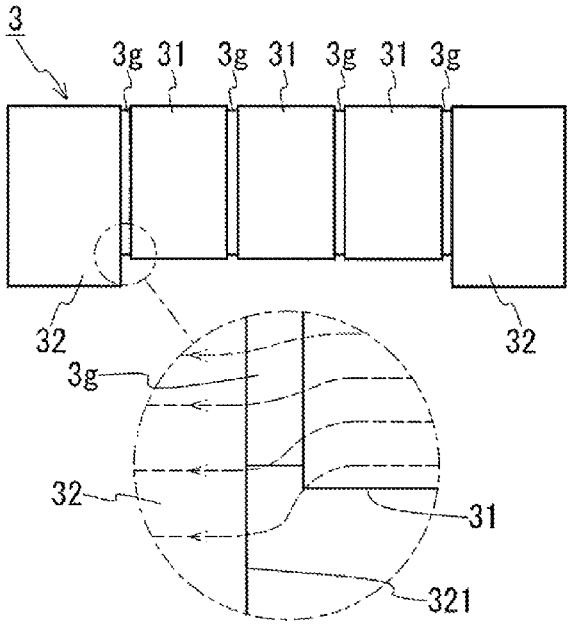

As shown in FIG. 7(A), the magnetic fluxes generated by the coil form a closed magnetic path along the annular core unit 3. Here, a description will mainly be given of the leakage fluxes at a gap member 3*g* interposed between the end core piece 32 and the intermediate core portion 30 (the intermediate core piece 31). Since the gap member 3*g* is smaller in relative permeability than each core piece, as shown in the enlarged views in FIGS. 7(A) and (B), the leakage fluxes tend to occur at the gap member 3*g* in the core unit 3. In a case where the clamping face 321 of each end core piece 32 is structured with a single plane, the leakage fluxes take a route that passes through the region that is positioned between the intermediate core portions 30 within the clamping face 321 of each end core piece 32 and that does not face the end face of the intermediate core piece 31, the route then passing through the end core piece 32 (see the enlarged view in FIG. 7(A)). Further, in a case where each end core piece 32 has a projecting portion that projects further than each intermediate core piece 31, the leakage fluxes take a pass that passes through the region of the projecting portion in the clamping face 321 in the end core piece 32 and that passes through the end core piece 32 (see the enlarged view in FIG. 7(B)).

Figure 8:
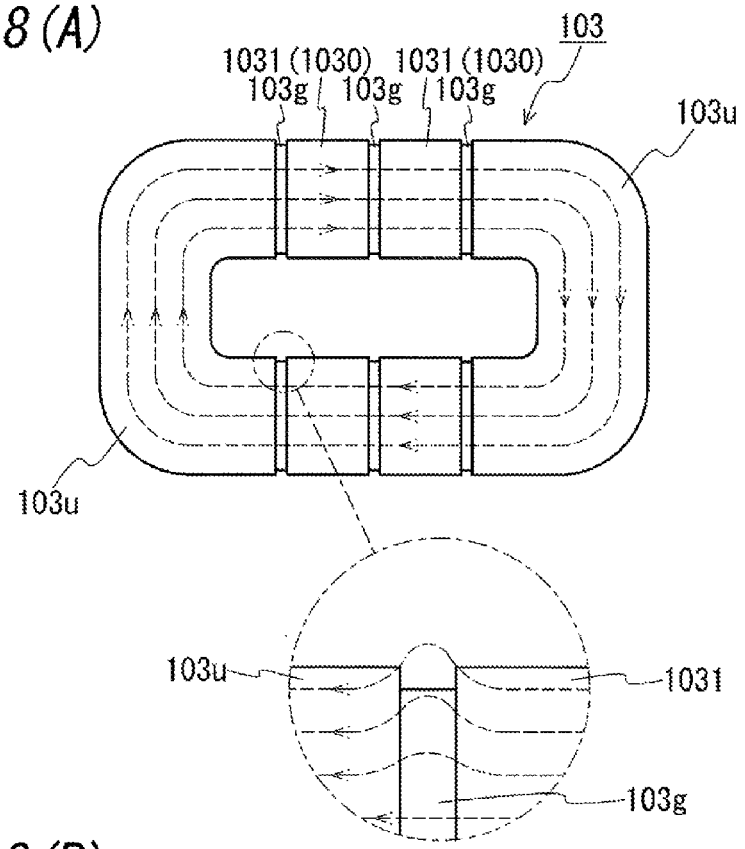
FIG. 8 is a diagram describing leakage fluxes at a gap member in a conventional reactor, where (A) is a plan view and a partial enlarged view thereof, and (B) is a front view and a partial enlarged view thereof.
Figure 8:
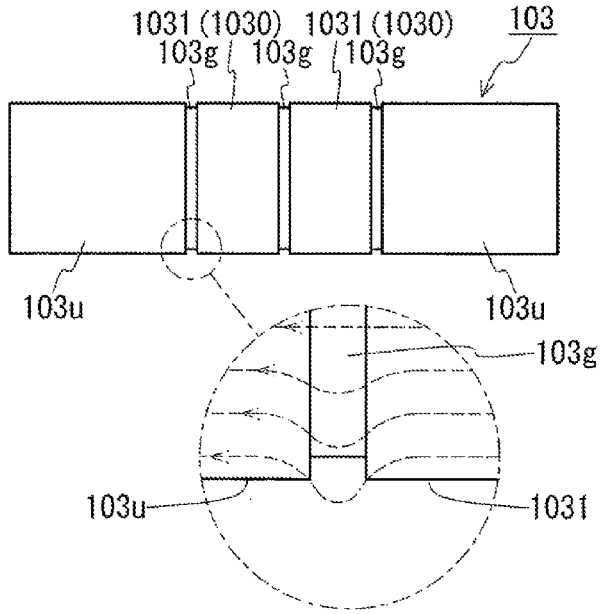

As shown in FIG. 8, in connection with the conventional reactor, the core unit 103 includes the U-shaped core pieces 103*u* each having a pair of leg portions connected to the intermediate core portions 1030. The clamping face of each U-shaped core piece 103*u* is structured with two planes facing the end faces of the both intermediate core portions 1030 (see FIG. 8(A)). Further, the U-shaped core piece 103*u* is flat (see FIG. 8(B)). FIG. 8 schematically shows the magnetic fluxes that pass through the core unit of the conventional reactor (in the drawing, dashed arrows represent the flow of the magnetic fluxes).

A description will mainly be given of the leakage fluxes at the gap member 103*g* between the U-shaped core piece 103*u* and the intermediate core portion 1030 (intermediate core piece 1031). As shown in enlarged views of FIGS. 8(A) and (B), in the core unit 103, the leakage fluxes tend to occur at the gap member 103*g*. In a case of the U-shaped core piece 103*u*, the magnetic path curves such that it passes through each leg portion of the U-shaped core piece 103*u* facing the end face of the intermediate core piece 1031 (see the enlarged views in FIGS. 8(A) and (B)).

Figure 9A:
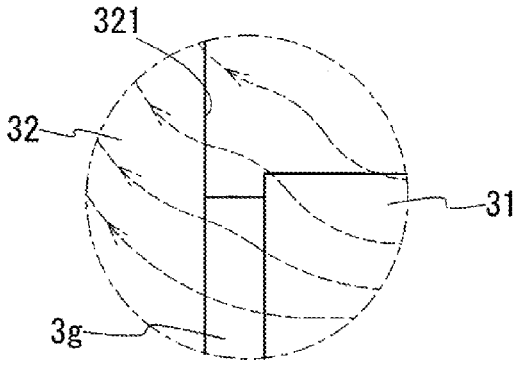
FIG. 9 is a diagram describing leakage fluxes at the gap member in a case where the relative permeability of the gap members in FIG. 7 becomes small, where (A) is a partial enlarged view of a plan view thereof, and (B) is a partial enlarged view of a front view thereof.
Figure 9B:
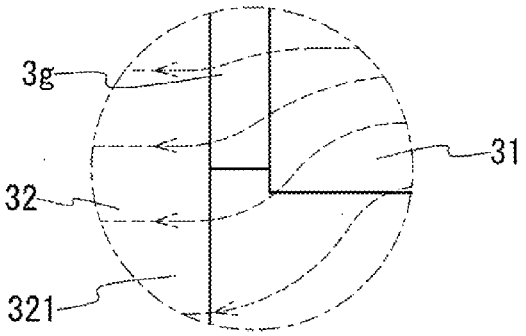

It is considered that, the greater the relative permeability of the gap member, the smaller the leakage fluxes, and hence the greater a reduction in the leakage fluxes that deviate from the core unit (the gap member) near the gap member in the core unit. On the other hand, it is considered that, the smaller the relative permeability of the gap member, the greater the leakage fluxes, and hence the greater the leakage fluxes that deviate from the core unit (the gap member) near the gap member in the core unit. For example, in a case where the relative permeability of the gap member is small (e.g., the relative permeability: 1), it is considered that the magnetic fluxes that pass through the gap member reduce and the leakage fluxes that deviate from the core unit increase, while the distance between the leakage fluxes widens. A description will be given of the core unit 3 shown in FIG. 7 as an example. In addition to the magnetic fluxes leaking from the core unit 3 near the gap member 3*g*, it is considered that part of the leakage fluxes tend to leak also from the surrounding surface of the core pieces (the end core piece 32 or the intermediate core piece 31) disposed on the opposite sides of the gap member 3*g*, and that the magnetic fluxes largely deviate from the core unit 3 increase (see FIGS. 9(A) and (B)). Here, in such a case where the magnetic fluxes that largely deviate from the core unit increase, the leakage fluxes cross the wire structuring the coil. This tends to cause eddy current loss at the coil, and reactor loss (copper loss) increases.

In this manner, since the core unit is formed to have a particular shape and the gap members are disposed each at a specific position, the reactor of the present invention can achieve a smaller number of components and more excellent assemblability despite its being smaller in size as compared to the conventional reactor. Further, since the relative permeability of the gap members are set to be greater than 1, the loss incurred by the leakage fluxes, particularly the loss that is caused by the leakage fluxes crossing the wire of the coil can be reduced. Further, in connection with the end core pieces, it is considered that, since the clamping faces clamping the intermediate core portions are each structured with a single plane, the loss that is caused by the leakage fluxes occurring between the end core piece and the intermediate core piece crossing the wire of the coil can be reduced.

Note that the embodiments described in the foregoing can appropriately be changed without departing from the gist of the present invention, and the present invention is not limited to the structure described above.

INDUSTRIAL APPLICABILITY

The reactor of the present invention can suitably be used as a constituent component of, e.g., an in-vehicle component such as an in-vehicle converter installed in a vehicle such as a hybrid vehicle, an electric vehicle, a fuel cell vehicle and the like.

REFERENCE SIGNS LIST

1: REACTOR
2: COIL
2*a*, 2*b*: COIL ELEMENT
2*w*: WIRE
2*r*: COUPLE PORTION
3: CORE UNIT
30: INTERMEDIATE CORE PORTION
31: INTERMEDIATE CORE PIECE
32: END CORE PIECE
3*g*: GAP MEMBER
320: TRAPEZOIDAL FACE
321: CLAMPING FACE
31*l*, 320*l*: INSTALLED FACE
321*i*: INNER REGION
321*o*: OUTER REGION
31*s*: OUTER SIDE FACE
100: REACTOR
102: COIL
102*a*, 102*b*: COIL ELEMENT
103: CORE UNIT
103*g*: GAP MEMBER
1030: INTERMEDIATE CORE PORTION
1031: INTERMEDIATE CORE PIECE
103*u*, 104*u*: U-SHAPED CORE PIECE

The invention claimed is:

1. A reactor, comprising:

a coil including a pair of left and right coil elements having their respective axes paralleled to each other; and a core unit formed to be annular by a combination of a plurality of magnetic core pieces and gap members each disposed between each ones of the magnetic core pieces, the core unit having a pair of left and right intermediate core portions around which the coil elements are respectively disposed, wherein the magnetic core pieces are each structured with a powder magnetic core, the magnetic core pieces include at least one intermediate core piece structuring each of the intermediate core portions, and the magnetic core pieces include a pair of end core pieces disposed so as to clamp the intermediate core portions around which the coil elements are disposed, the pair of end core pieces having no coil disposed thereto wherein the end core pieces respectively include clamping faces that clamp the intermediate core portions disposed in parallel to each other, the clamping faces each being structured with a single plane, and out of the gap members, at least one gap member is disposed between one of the end core pieces and the intermediate core piece, the gap members having a relative permeability being greater than or equal to 1.05 and smaller than or equal to 10, wherein an axial direction is an axial direction of the coil elements, wherein a width direction is a direction perpendicular to the axial direction and passing through both of the center of the left and right coil elements, wherein a vertical direction is a direction perpendicular to the axial direction and the width direction, wherein the lower side in the vertical direction is an installation side of the reactor, wherein a lower face of the end core pieces projects lower than a lower face of the intermediate core portions in the vertical direction, or an upper face of the end core pieces projects higher than an upper face of the intermediate core portions in the vertical direction, so that a projecting portion is formed in a lower or upper portion of the clamping faces.

2. The reactor according to claim 1, wherein the lower face of the end core pieces projects lower than the lower face of the intermediate core portions, and the upper face of the end core pieces projects upper than an upper face of the intermediate core portions, so that the projecting portions are formed in both the lower and upper portion of the clamping faces.

3. The reactor according to claim 1, wherein a left side external periphery of the clamping faces projects more left than a left side face of the left side intermediate core portion, and a right side external periphery of the clamping faces projects more right than a right side face of the right side intermediate core portion, so that the projecting portions are formed in both a left and right portion of the clamping faces.

4. The reactor according to claim 1, wherein the gap members have a relative permeability being smaller than or equal to 2.0.

5. The reactor according to claim 1, wherein the gap members are made of resin mixed with magnetic powder.

6. The reactor according to claim 4, wherein the gap members have a relative permeability being smaller than 1.5.

7. The reactor according to claim 1, wherein the gap members have a relative permeability being greater than or equal to 1.1.

8. The reactor according to claim 1, wherein a gap member has a thickness of 2.095 mm or more.

* * * * *